US010487709B2

(12) United States Patent
Xu et al.

(10) Patent No.: US 10,487,709 B2
(45) Date of Patent: Nov. 26, 2019

(54) OIL PAN IN AN ENGINE ASSEMBLY AND A CRANKCASE VENTILATION SYSTEM

(71) Applicant: Ford Global Technologies LLC, Dearborn, MI (US)

(72) Inventors: Xihu Xu, Nanjing (CN); Qin Zhu, Nanjing (CN)

(73) Assignee: Ford Global Technologies LLC, Dearborn, MI (US)

( * ) Notice: Subject to any disclaimer, the term of this patent is extended or adjusted under 35 U.S.C. 154(b) by 197 days.

(21) Appl. No.: 15/691,330

(22) Filed: Aug. 30, 2017

(65) Prior Publication Data

US 2018/0073403 A1 Mar. 15, 2018

(30) Foreign Application Priority Data

Sep. 13, 2016 (CN) ..... 2016 1 0822410

(51) Int. Cl.
*F01M 11/04* (2006.01)
*F01M 11/00* (2006.01)

(52) U.S. Cl.
CPC ..... *F01M 11/0458* (2013.01); *F01M 11/0004* (2013.01)

(58) Field of Classification Search
CPC .... F01M 11/0004; F01M 13/04; F01M 11/02; F01M 13/022; F01M 2005/023
USPC ..... 184/106
See application file for complete search history.

(56) References Cited

U.S. PATENT DOCUMENTS 2,493,617 A 1/1950 Chubbuck
4,501,234 A * 2/1985 Toki ..... F01M 13/025 123/196 R
4,616,609 A * 10/1986 Munch ..... F01M 1/02 123/196 AB
4,773,366 A * 9/1988 Seidl ..... F01M 11/02 123/195 C
5,069,192 A * 12/1991 Matsumoto ..... F01M 13/02 123/41.86
5,301,642 A * 4/1994 Matsushiro ..... F01M 5/001 123/142.5 R
5,452,692 A * 9/1995 Spray ..... F01M 11/00 123/195 C
6,041,752 A * 3/2000 Van Klompenburg ..... F01M 11/0004 123/195 C
6,167,990 B1 * 1/2001 Peng ..... F01M 11/064 123/196 W
6,234,154 B1 * 5/2001 Spix ..... F01M 13/022 123/572
6,520,164 B1 * 2/2003 Lepp ..... F01M 13/04 123/572
6,530,354 B1 * 3/2003 Bishop ..... F01M 11/0004 123/195 C
6,640,767 B2 * 11/2003 Kato ..... F01M 5/02 123/195 C (Continued)

FOREIGN PATENT DOCUMENTS

DE 19632931 C2 12/1999

*Primary Examiner* — Henry Y Liu
(74) *Attorney, Agent, or Firm* — Geoffrey Brumbaugh; Kolitch Romano LLP

(57) ABSTRACT

An oil pan in an engine assembly comprises a housing including a bottom wall and a sidewall and an oil drain tube. The oil drain tube includes a tubing wall and a portion of the sidewall and is integrally formed with the housing.

13 Claims, 3 Drawing Sheets

(56) References Cited

U.S. PATENT DOCUMENTS

| | | | | |
|---|---|---|---|---|
| 6,854,454 | B2 * | 2/2005 | Obayashi | F01M 13/04 123/572 |
| 7,047,955 | B2 * | 5/2006 | Ookawa | F01M 13/022 123/572 |
| 7,069,899 | B1 * | 7/2006 | Okuda | F01M 11/0004 123/195 C |
| 7,322,335 | B2 * | 1/2008 | Suzuki | F01M 11/045 123/195 C |
| 7,373,911 | B2 * | 5/2008 | Taguchi | F01M 11/02 123/195 C |
| 7,506,629 | B2 * | 3/2009 | Kawamura | F01M 13/0416 123/195 C |
| 7,849,841 | B2 * | 12/2010 | Holzmann | F01M 13/04 123/41.86 |
| 8,020,540 | B2 * | 9/2011 | Hornung | F01M 13/00 123/196 R |
| 8,887,703 | B2 * | 11/2014 | Valencia | F01M 13/022 123/572 |
| 2002/0129783 | A1 * | 9/2002 | Lawrence | F01M 1/16 123/195 C |
| 2007/0246001 | A1 * | 10/2007 | Taguchi | F01M 11/02 123/196 R |
| 2010/0313860 | A1 | 12/2010 | Miller et al. | |

* cited by examiner

OIL PAN IN AN ENGINE ASSEMBLY AND A CRANKCASE VENTILATION SYSTEM

RELATED APPLICATION

This application claims the benefit of Chinese Patent Application No.: CN 201610822410.3 filed on Sep. 13, 2016, the entire contents thereof being incorporated herein by reference.

FIELD

The present application relates to an oil pan in an engine assembly and an engine crankcase ventilation system, in particular, relates to an oil pan with an integrally formed oil drain tube.

BACKGROUND

An issue of an engine oil consumption in an engine causes more attention in the design of an engine assembly in automotive industries. Reduction on the engine oil consumption may be achieved by improvement on a positive crankcase ventilation (PCV) system. With a high-performance oil separator, a high capacity oil drain tube in the PCV system is required.

An oil drain tube is usually an individual tube disposed in the oil pan of the PCV system. However, the individual oil drain tube in the oil pan has some issues, such as difficulty on package and the NVH problem caused by the oil drain tube. In some oil pans, an oil drain tube is replaced by a check valve. However, the use of the check valve increases a manufacturing cost, and the oil residue in the oil pan may wear the check valve and thus affect its normal operation.

SUMMARY

According to an aspect of the present disclosure, an oil pan in an engine assembly is provided. The oil pan comprises a housing including a bottom wall and a sidewall; and an oil drain tube having an inlet and an outlet. The oil drain tube extends along the sidewall to the bottom wall and is integrally formed with the housing.

In one embodiment, the oil drain tube includes a tubing wall integrated with the housing, and the tubing wall and at least a portion of the sidewall collectively form an oil path of the drain tube.

In another embodiment, the oil drain tube extends along the sidewall and the outlet of the oil tube is disposed to open toward the bottom wall.

In another embodiment, the oil drain tube includes a first tubing section extending along the sidewall and a second tubing section extending along the bottom wall.

In another embodiment, the housing further includes an inclined wall connecting the bottom wall and the sidewall, and the oil drain tube further includes a first tubing section extending along the sidewall and a second tubing section extending along the inclined wall. The first tubing section and the second tubing section form an angle greater than 90 degrees.

In another embodiment, the outlet of the oil drain tube is disposed adjacent to an interface of the inclined wall and the bottom wall.

In another embodiment, the outlet of the oil drain tube extends to a pyramid region on the bottom wall of the housing, and the pyramid region is a region containing oil at different driving conditions.

In another embodiment, the inlet of the oil drain tube is disposed at a housing assembling surface of the housing and the outlet of the oil drain tube is disposed toward the bottom wall.

In another embodiment, the oil drain tube and the housing are formed by an injection molding or a die cast. The oil drain tube includes a tubing wall formed on the sidewall, and the tubing wall and a portion of the sidewall collectively form the oil drain tube.

According to another aspect of the present disclosure, an oil pan in an engine assembly is provided. The oil pan comprises a housing having a bottom wall and a sidewall, and an oil drain tube including a first tubing section integrally formed with the sidewall. A portion of the sidewall constitutes a portion of the first tubing section.

In one embodiment, the oil drain tube further comprising a second tubing section integrally formed on the bottom wall at a same process as that of the first tubing section. An end of the second tubing section includes an outlet disposed on the bottom of the housing.

In another embodiment, the second tubing section forms an angle of greater than 90 with the first tubing section.

In another embodiment, a cross section of the first tube section that is perpendicular to an axis of the first tubing section has a partial annular ring shape, a square or a rectangular shape.

According to another embodiment, an engine crankcase ventilation system comprises a crankcase and an oil pan assembled on the crankcase. The oil pan includes a housing connected to the crankcase and including a bottom wall and a sidewall extending from the bottom wall, and an oil drain tube disposed inside the housing and formed integrally with the housing. The oil drain tube extends along the sidewall to the bottom wall, and an inlet of the oil drain tube is communicated with an oil drain tube of the crankcase.

In one embodiment, the oil drain tube includes a tubing wall integrally formed with the housing and the tubing wall and at least a portion of the sidewall of the housing collectively form an oil path of the oil drain tube.

In another embodiment, the housing further includes an inclined wall connecting the bottom wall and the sidewall. The oil drain tube further includes a first tubing section extending along the sidewall and a second tubing section extending along the inclined wall, and the first tubing section and the second tubing section form an angle greater than 90 degrees.

In another embodiment, the outlet of the oil drain tube is disposed adjacent an interface of the bottom wall and the sidewall, and the interface is located at a pyramid region on the bottom wall of the housing. The pyramid region is a region which contains oil at different driving conditions.

In another embodiment, the outlet of the oil drain tube extends to a pyramid region above the bottom wall of the housing, and the pyramid region is a region which contains oil at different driving conditions.

In another embodiment, the housing further includes a housing assembling surface and the crankcase includes a crankcase assembling surface connected with the housing assembling surface. The inlet of the oil drain tube of the oil pan is aligned with and connected to the oil drain tube of the crankcase.

In another embodiment, the oil drain tube and the housing are formed via an injection molding or a die casting.

The oil pan in an engine assembly and the positive crankcase ventilation system of the present disclosure have several advantages. For example, the oil drain tube and the housing of the oil pan are formed integrally as a single part in a manufacturing process. Since the oil drain tube formed integrally with the housing, the difficulty in packaging of the oil pan is reduced. Further, the issues caused by the collision of the oil drain tube with the housing can be avoided. Furthermore, the oil drain tube extends along the bottom wall of the housing, which makes it easy to keep an outlet of the oil drain tube submerged in the oil, and thus prevent the oil being sucked into the drain tube and avoid the use of a complicated check valve.

BRIEF DESCRIPTION OF THE DRAWINGS

Example embodiments will be more clearly understood from the following brief description taken in conjunction with the accompanying drawings. The accompanying drawings represent non-limiting, example embodiments as described herein.

It should be noted that these figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. The use of similar or identical reference numbers in the various drawings is intended to indicate the presence of a similar or identical element or feature.

DETAILED DESCRIPTION

The disclosed oil pans in an engine assembly and engine crankcase ventilation systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various oil pans in an engine assembly and engine crankcase ventilation system are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1:
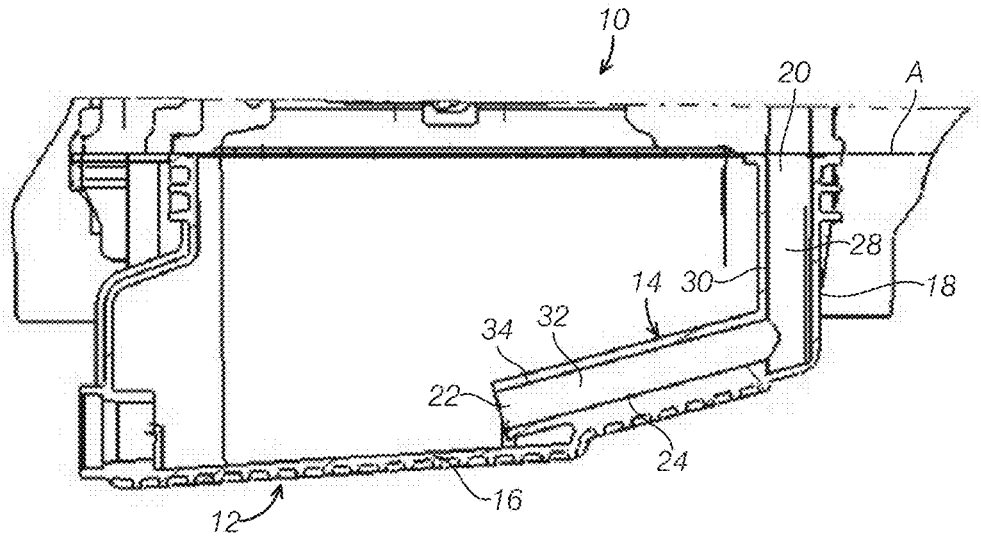
FIG. 1 is a cross-section view of an oil pan in an engine assembly according to one embodiment of the present disclosure.

Referring to FIG. 1, a cross-section view of an oil pan 10 in an engine assembly according to one embodiment of the present disclosure is shown. The oil pan 10 in an engine assembly comprises a housing 12 and an oil drain tube 14. The housing 12 includes a bottom wall 16 and a sidewall 18 extending from the bottom wall 16. The bottom wall 16 and the sidewall 18 forms a housing 12. The oil drain tube 14 includes an inlet 20 and an outlet 22 opposite to the inlet 20. The oil drain tube 14 extends along a sidewall 18 to the bottom wall 16 and is integrally formed with the housing 12. In some embodiments, the oil drain tube 14 and the housing 12 are integrally formed via an injection molding or a die casting. It should be understood that any appropriate manufacturing process may be used to form the oil drain tube integrally with the oil pan.

The oil drain tube 14 and the housing 10 of the oil pan 14 are formed integrally as a single piece. Since the oil drain tube 14 is formed integrally with the housing 12, difficulty in packaging of the oil pan 10 can be reduced, and the issues due to the collision of the oil drain tube 14 with the housing 12 can be avoided. Further, the oil drain tube 14 extends toward the bottom wall 16 of the housing 12, which makes the outlet 22 of the oil drain tube 14 be submerged in the oil easily, thus prevent an oil to flow back by suction. Further, there is no need for a complicated check valve.

Further referring to FIG. 1, in one embodiment, the oil drain tube 14 includes a tubing wall formed integrated with the housing 12, and the tubing wall 26 and portion of the sidewall 18 collectively form an oil path of the drain tube 14. In other words, the oil drain tube 14 may not be a separate tube, but may be a tube collectively formed by tubing wall and the inner wall of the housing 12 (such as sidewall 18). The engine oil flows passing the drain tube 14 to enter the housing 12.

In the depicted embodiment, the drain tube 14 includes a first tubing section 28 disposed along the sidewall 18 and including a first tubing wall 30 and a second tubing section 32 disposed on an inclined wall 24 and including a second tubing wall 34. A cross section of the first tubing wall 30 at a plane perpendicular to an axis of the first tubing section 28 may be a portion of an annular ring. Similarly, a cross section of the tubing wall 34 of the second tubing section 32 may be a portion of an annular ring. In some embodiments, a flow area of the first tubing section 28 may be the same as a flow area of the second tubing section 32. It should be appreciated that the cross section of the first and second tubing wall 30 and 34 may have any appropriate shapes such as a square or a rectangular. Further, it should be appreciated that the drain tube 14 can be disposed at an appropriated position on the sidewall or the bottom wall.

Continuing with FIG. 1, the housing may include an inclined wall 24. That is, the inclined wall 24 is located between the bottom wall 16 and the sidewall 18. In other words, the inclined wall 24 connects the sidewall 18 and bottom wall 16 to form a transition wall between the bottom wall 16 and the sidewall 18. The first tubing section 28 extends along the sidewall 18 and the second tubing section 32 extends along the inclined wall 24, and the first tubing section 28 and the second tubing section 32 may form an angle greater than 90 degrees. When the angle between the two tubing sections is greater than 90 degrees, it is easy for the oil flowing in the first tubing section 28 and the second tubing section 32 to reduce flow resistance.

Further referring to FIG. 1, in one embodiment, the outlet 22 of the oil drain tube 14 may be disposed at or adjacent to an interface of the inclined wall 24 and the bottom wall 16. The outlet 22 opens toward the bottom wall 16 to improve an oil flowing.

Figure 4:
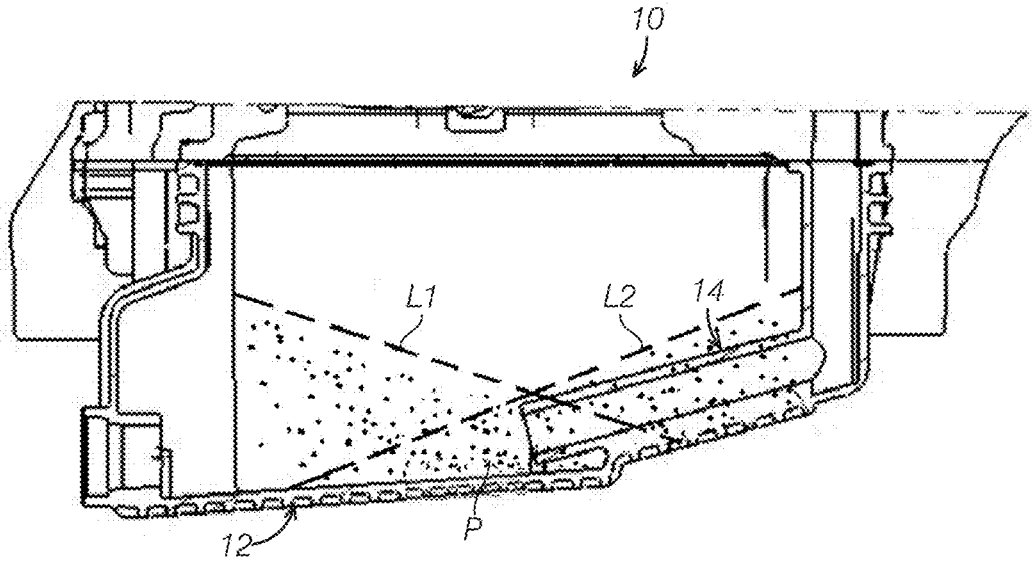
FIG. 4 is a schematic view on the change of an oil level under different situations, illustrating a pyramid region in an oil pan.

Referring to FIGS. 1 and 4, in one embodiment, the outlet 22 of the oil drain tube 14 extends to a pyramid region P formed on the bottom wall 16 of the housing 12. It should be noted that the pyramid region P refers to a region in the housing 12, which always contain an oil under any driving situations (e.g., acceleration, deacceleration, a left turn, or a right turn). When the vehicle starts forward with an acceleration, the engine oil in the oil pan 10 sways due to an inertia, which turns an oil surface of the engine oil from a flat level to an inclined level, as shown in dashed line L1 in FIG. 4. When the vehicle is decelerating or braking, the engine oil in the oil pan 10 sways to an opposite direction due to the inertia, resulting in a change of an oil level from a flat level to an inclined level, as shown in dashed line L2 in FIG. 4. Similarly, when the vehicle is making a left turn or a right turn, an inclined oil level similar to that shown in dash lines in FIG. 4 also occurs. When the inclined surfaces are overlaid under these driving situations, the pyramid region P is formed on the bottom wall 16 of the housing 12. When the outlet 22 of the oil drain tube 14 extends to or is disposed in this region, the outlet of the oil drain tube 14 can be always submerged in the engine oil under various driving conditions if a certain amount of the oil is contained in the oil pan. Thus, the problem caused by the suction of the engine oil back to the oil drain tube 14 due to high vacuum can be effectively prevented.

Continuing with FIG. 1, in an embodiment, the inlet 20 of the oil drain tube 14 may extend to or disposed on a housing assembling surface A of the housing 12, and the outlet 22 of the oil drain tube 14 is disposed toward the bottom wall 16 of the housing 12. When the inlet 20 of the oil drain tube 14 extends to the housing assembling surface A, the oil drain tube 14 can be directly connected with a crankcase oil drain tube of the crankcase when the oil pan is connected to the crankcase, which can reduce assembling difficulty.

Figure 2:
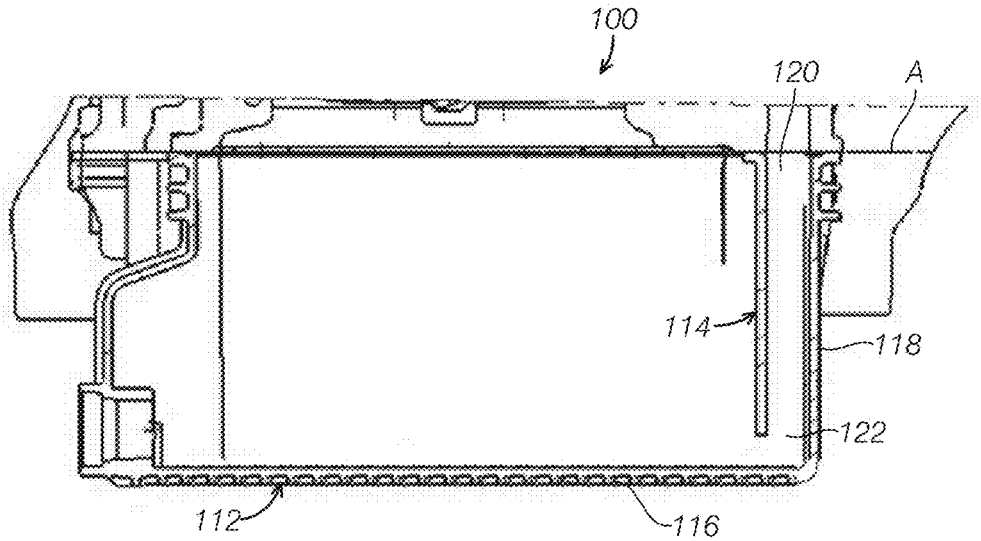
FIG. 2 is a cross-section diagram of an oil pan in an engine assembly according to another embodiment of the present disclosure.

It should be understood that the tubing wall may only be connected with the sidewall 18 to form the oil path of the oil drain tube 14. Referring to FIG. 2, in one embodiment, a housing 112 of an oil pan 100 include an oil drain tube 114 extending along a sidewall 118 of the housing 112. The outlet 122 of the oil drain tube 114 is disposed to open toward a bottom wall 116 of the housing 112. In other words, the oil drain tube 114 is only formed on the sidewall 118 of the housing 112, and does not extend along the bottom wall 116.

Figure 3:
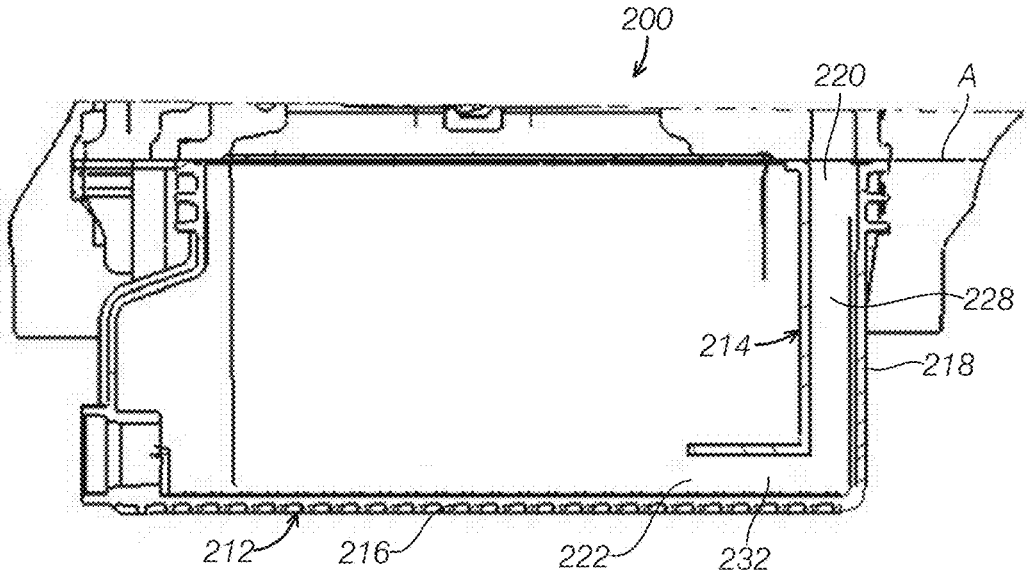
FIG. 3 is a cross-section view of an oil pan in an engine assembly according to another embodiment of the present disclosure.

Referring to FIG. 3, an oil pan 200 according to another embodiment of the present disclosure is illustrated. The oil pan 200 includes a housing 212 and an oil drain tube 214. The oil drain tube 214 includes a first tubing section 228 and a second tubing section 232 which extends along with a sidewall 218 and a bottom wall 216 of the housing 212, respectively. The first tubing section 228 and the second tubing section 232 may form a L shape. It should be understood the oil drain tube may have any appropriated configuration to be integrated to the sidewall and/or bottom of the housing.

Further, it should be appreciated that the oil drain tube may be disposed at any appropriate position on the sidewall and the bottom wall. For example, the oil drain tube may include a first tubing section disposed on a middle portion of one sidewall and integrated to the side wall. In the embodiment where the oil drain tube has a second tubing section, the second tubing section may be disposed on a middle portion of the bottom wall. In another example, the sidewall of the housing may include a first sidewall and a second sidewall connected to the first sidewall. The first tubing section of the oil drain tube may be disposed at a corner formed by the first sidewall and the second sidewall. The oil drain tube is integrally formed by a tubing wall and a portion of the first sidewall and a portion of the second sidewall. In the embodiment where the oil drain tube has a second tubing section, the second tubing section may be integrally formed by a portion of the bottom wall and a portion of the second sidewall of the housing.

Referring to 5 and with further reference to FIG. 1, an engine crankcase ventilation system 300 is provided. In some embodiments, the engine crankcase ventilation system 300 may be a positive crankcase ventilation system. The engine crankcase ventilation system 300 comprises a crankcase 332 and an oil pan 10. As an example, the oil pan 10 illustrated in FIG. 1 is included in the engine crankcase ventilation system 300. The oil pan 10 is assembled with the crankcase 332. The oil pan 10 includes an oil drain tube 14 integrated formed with a housing 12 of the oil pan 10. In some embodiments, the engine crankcase ventilation system 300 includes the oil pan 10 having a housing 12 and an oil drain tube 14. The housing 12 is connected to the crankcase 332. The housing 12 includes a bottom wall 16 and a sidewall 18 extending from the bottom wall 16. The oil drain tube 14 is disposed inside the housing 12 and is formed integrally with the housing 12. The oil drain tube 14 extends along the sidewall 18 of the housing 12 to the bottom wall 16 and further extends on an inclined wall. An inlet 20 of the oil drain tube 14 is communicated with an oil drain tube 334 of the crankcase 332.

As described above, in the engine crankcase ventilation system 300, the oil drain tube 14 is integrally formed with the housing 12 of the oil pan 10, and thus the oil drain tube 14 and the housing 12 of the oil pan 10 are formed as an integral part as a single piece. Further, due to the integration of the oil drain tube 14 and the housing 12, difficulty in packaging g the oil pan 10 is reduced, and a problem of collision of the oil drain tube 14 with the housing 12 can be avoided. In addition, the oil drain tube 14 extends to the bottom wall 16 of the housing 12, therefore, the outlet 22 of the oil drain tube 14 is easily submerged in the engine oil of the oil pan 10 to prevent an engine oil to flow back and thus avoid the use of a complicated check valve.

Figure 5:
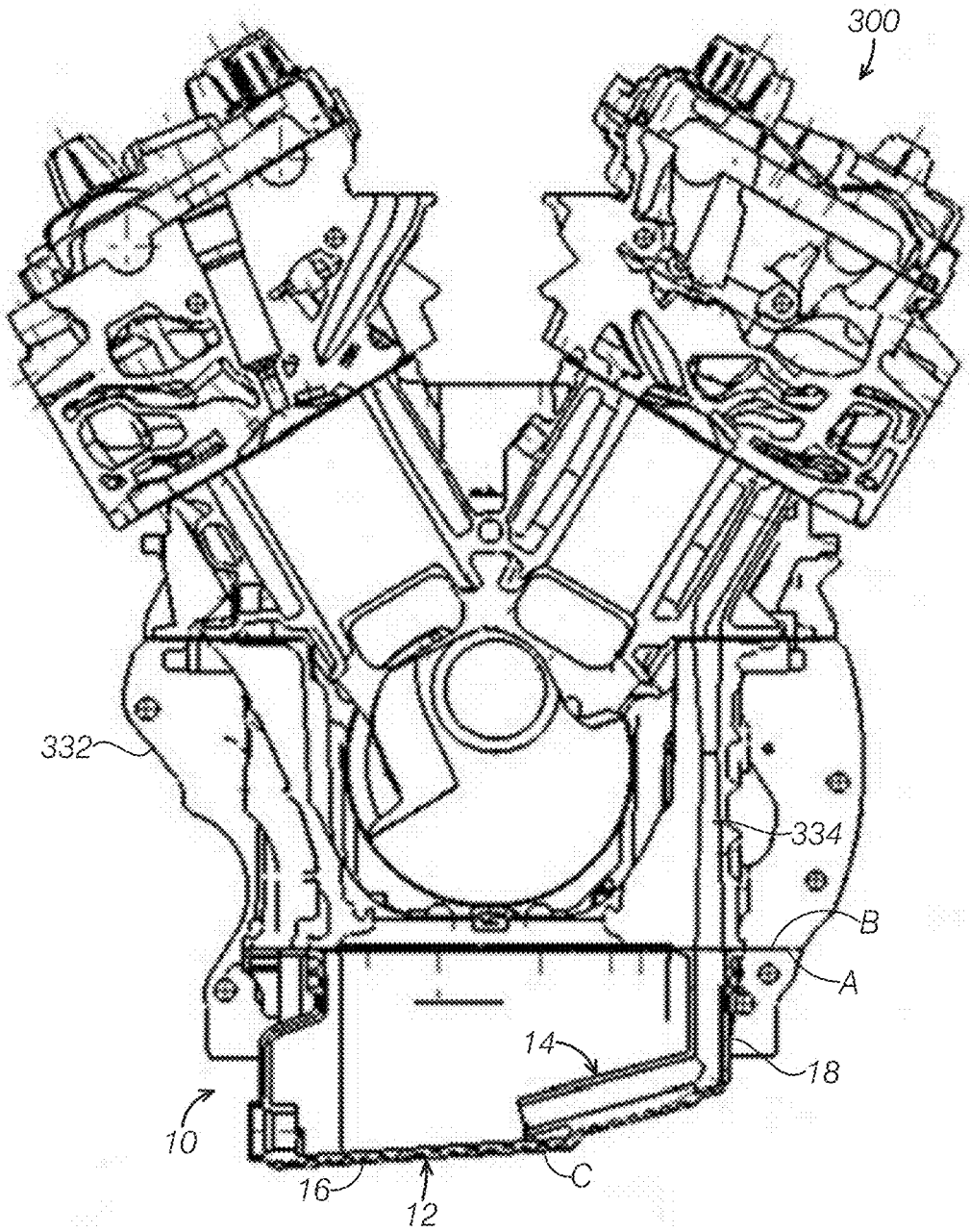
FIG. 5 is a cross section view of an engine crankcase ventilation system according to one embodiment of the present disclosure.

Continuing with FIG. 5 and with further reference with FIG. 1, in an embodiment, the oil drain tube 14 includes a tubing wall integrally formed with the housing 12, and the tubing wall and the sidewall of the housing 12 collectively form an oil path of the oil drain tube 14. Furthermore, in an embodiment, the housing 12 of the oil pan includes an inclined wall 24, as described above in association with FIG. 1. The outlet 22 of the oil drain tube 14 is disposed adjacent to an interface C of the bottom wall 16 and the inclined wall 24, and the interface C is located in a pyramid region P formed on the bottom wall 16 of the housing 12 (as shown in FIG. 4). In an alternative embodiment as shown in FIG. 3, wherein there is no inclined wall, the outlet 222 of the oil drain tube 214 may extend into the pyramid region P formed on the bottom wall 216 of the housing 212 directly. Similarly, as described above, the outlet 22 of the oil drain tube 14 is configured to extend to the pyramid region to ensure that the outlet 22 of the oil drain tube 14 is submerged in the engine oil of the oil pan 10 to prevent a problem due to back flow of the engine oil into the oil drain tube 14 under a high vacuum condition.

In an embodiment shown in FIG. 5, the housing 12 further includes a housing assembling surface A and the crankcase 300 includes a crankcase assembling surface B, and the inlet 20 of the oil drain tube 14 is connected to the oil drain tube 334 of the crankcase at an interface of the housing assembling surface A and the crankcase assembling surface B. In other words, the housing assembling surface A and the crankcase assembling surface B form two surfaces to connect the housing 12 and the crankcase 332. The oil drain tube 14 of the oil pan 10 is aligned with the oil drain tube 334 of the crankcase 332 to be directly connected with the oil drain tune 334, thus, reducing an assembling difficulty.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions.

The following claims particularly point out certain combinations and subcombinations regarded as novel and non-obvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

The invention claimed is:

1. An oil pan in an engine assembly, comprising:

a housing forming the oil pan, wherein the housing includes a bottom wall, a housing assembling surface opposite the bottom wall, and a sidewall extending from the housing assembling surface to the bottom wall; and an oil drain tube having an inlet and an outlet, wherein the inlet is disposed on the housing assembling surface and the oil drain tube extends from the housing assembling surface to the bottom wall along the sidewall and is integrally formed with the housing.

2. The oil pan of claim 1, wherein the oil drain tube includes a tubing wall integrated with the housing, and wherein the tubing wall and at least a portion of the sidewall collectively form an oil path of the oil drain tube.

3. The oil pan of claim 1, wherein the oil drain tube extends along the sidewall and the outlet of the oil drain tube is disposed to open toward the bottom wall.

4. The oil pan of claim 1, wherein the oil drain tube includes a first tubing section extending from the housing assembling surface to the bottom wall along the sidewall and a second tubing section extending along the bottom wall.

5. The oil pan of claim 1, wherein the housing further includes an inclined wall connecting the bottom wall and the sidewall, wherein the oil drain tube further includes a first tubing section extending along the sidewall and a second tubing section extending along the inclined wall, and wherein the first tubing section and the second tubing section form an angle greater than 90 degrees.

6. The oil pan of claim 5, wherein the outlet of the oil drain tube is disposed at an interface of the inclined wall and the bottom wall.

7. The oil pan of the claim 1, wherein the outlet of the oil drain tube extends to a pyramid region on the bottom wall of the housing, and wherein the pyramid region is a region containing oil at different driving conditions.

8. The oil pan of claim 1, wherein the outlet of the oil drain tube is disposed toward the bottom wall.

9. The oil pan of claim 1, wherein the oil drain tube and the housing are formed via an injection molding or a die cast and wherein the oil drain tube includes a tubing wall formed on the sidewall, and wherein the tubing wall and a portion of the sidewall collectively form the oil drain tube.

10. An oil pan in an engine assembly in a vehicle, comprising:

a housing having a bottom wall, a housing assembling surface opposite the bottom wall, and a sidewall extending between the housing assembling surface and the bottom wall; and an oil drain tube including a first tubing section and a second tubing section, wherein the first tubing section extends from housing assembling surface to the bottom wall, and wherein the first tubing section and the second tubing section are integrally formed with the sidewall and the bottom wall of the housing, respectively, wherein a portion of the sidewall and a portion of the bottom wall constitute a portion of the oil drain tube.

11. The oil pan of claim 10, wherein the first tubing section and the second tubing section are integrally formed on the in a same process and wherein an end of the first tubing section includes an inlet extending to the housing assembling surface and an end of the second tubing section includes an outlet disposed on the bottom wall of the housing.

12. The oil pan of claim 11, wherein the second tubing section forms an angle of greater than 90 with the first tubing section.

13. The oil pan of claim 10, wherein a cross section of the first tubing section that is perpendicular to an axis of the first tubing section has a partial annular ring shape, a square or a rectangular shape.

* * * * *